United States Patent [19]

Kreeger

[11] 4,383,611

[45] May 17, 1983

[54] THREE-LEVEL STACK AND NEST CONTAINER

[75] Inventor: Elsmer W. Kreeger, Allegan, Mich.

[73] Assignee: Pinckney Molded Plastics, Inc., Pinckney, Mich.

[21] Appl. No.: 340,114

[22] Filed: Jan. 18, 1982

[51] Int. Cl.[3] ..... B65D 21/04

[52] U.S. Cl. ..... 206/505

[58] Field of Search ..... 206/505, 506, 507

[56] References Cited

U.S. PATENT DOCUMENTS

| | | | |
|---|---|---|---|
| 4,000,817 | 1/1977 | Sanders | 206/507 |
| 4,102,453 | 7/1978 | Carroll et al. | 206/507 |
| 4,211,324 | 7/1980 | Stahl | 206/505 |
| 4,320,837 | 3/1982 | Carroll et al. | 206/505 |
| 4,334,616 | 6/1982 | Wilson | 206/505 |

*Primary Examiner*—George E. Lowrance

*Attorney, Agent, or Firm*—Basile, Weintraub & Hanlon

[57] ABSTRACT

A three-level stack and nest container is provided with a row of outwardly projecting stacking feet along the lower edges of a pair of opposed end walls. Three stacking foot receiving seats are formed at the inner side of each end wall at different elevations in vertical alignment with each stacking foot so that two containers may be stacked or nested with the upper container at a high, intermediate or low elevation relative to the lower container depending upon which set of seats of the lower container are engaged by the feet of the upper container. Each vertically aligned group of seats includes recesses in the inner side of the end wall extending downwardly at opposite sides of the uppermost of the three seats. One recess will guide a stacking foot to the intermediate seat, the other recess will guide a stacking foot to the lower of the three seats.

12 Claims, 10 Drawing Figures

THREE-LEVEL STACK AND NEST CONTAINER

BACKGROUND OF THE INVENTION

The present invention is concerned with a tray-like container typically employed in the distribution of bakery products. Many examples of containers of this type are found in the prior art, see for example U.S. Pat. Nos. 3,951,265; 4,102,453; 4,189,052 and 4,211,327.

The containers of the type with which the present invention is concerned are typically designed so that like containers may be stacked one upon the other with the upper of the two containers being selectively supported at a high, intermediate or low elevation relative to the underlying container. The low elevation stacking finds the stacked containers in a (substantially) fully nested position relative to each other which will provide a stack of minimum height when the containers are empty. The intermediate and high level stacking relationships are employed depending upon the height of bakery products loaded upon one of the containers.

While three-level stacking as described above is quite common in the art, many different designs and structural arrangements have been employed to achieve three-level stacking. Some prior art designs require different orientations of the upper of two stacked containers relative to the lower to accomplish stacking at different levels. Other prior art arrangements find the stacked containers in the same front-to-rear orientation at all three stacking levels, which is generally considered to be a preferred arrangement, but are found difficult to stack in the desired relationship with each other, because the person who is manually stacking the containers must manually move selected mating surfaces on the two containers into engagement with each other without being able to clearly see what he is doing.

The present invention is especially directed to a three-level container in which the same front-to-rear orientation of two containers relative to each other is preserved at all three stacking levels, and in which the stacking elements of the upper of two containers being stacked are positively guided to the supporting portions of the lower container which establish the intermediate and lower level stacking positions.

SUMMARY OF THE INVENTION

A container embodying the present invention is formed with a generally rectangular bottom having two opposed end walls projecting upwardly at a slight outward inclination from opposite ends of the bottom. A row of horizontally spaced and aligned stacked feet are integrally formed along the lower edge of each end wall and project outwardly from the outer side of the end wall. Three vertically spaced and aligned stacking feet receiving seats are located at the inner side of the end wall above each of the stacking feet. The uppermost of these three seats is located closely adjacent the top edge of the end wall and will receive a corresponding stacking foot of a like container to support the like container at the high-level stacked position relative to the supporting container. At each side of each upper seat, a recess is formed in the inner side of the end wall to extend vertically downwardly from the top edge of the end wall. One of these recesses extends only a short distance below the upper seat and then continues with a downward inclination to the intermediate seat which is located vertically below the upper seat. The other of the two recesses extends a greater distance downwardly below the upper seat and merges into another downwardly inclined section which leads to the lower of the three seats. Stacking at the intermediate or lower level is accomplished simply by locating the support feet of the upper of the two containers at the upper end of the appropriate one of the two recesses and simply dropping the upper container, the support feet being guided by the recesses to the appropriate seat.

Downwardly projecting flanges on the support feet are seated outwardly of upwardly projecting retaining lips on at least the upper seats to positively retain the end walls of the supporting container against outward flexing movement induced on the lower containers when a relatively large number of containers are vertically stacked.

Other objects and features of the invention will become apparent by reference to the following specification and to the drawings.

IN THE DRAWINGS

DESCRIPTION OF THE PREFERRED EMBODIMENT

Figure 1:
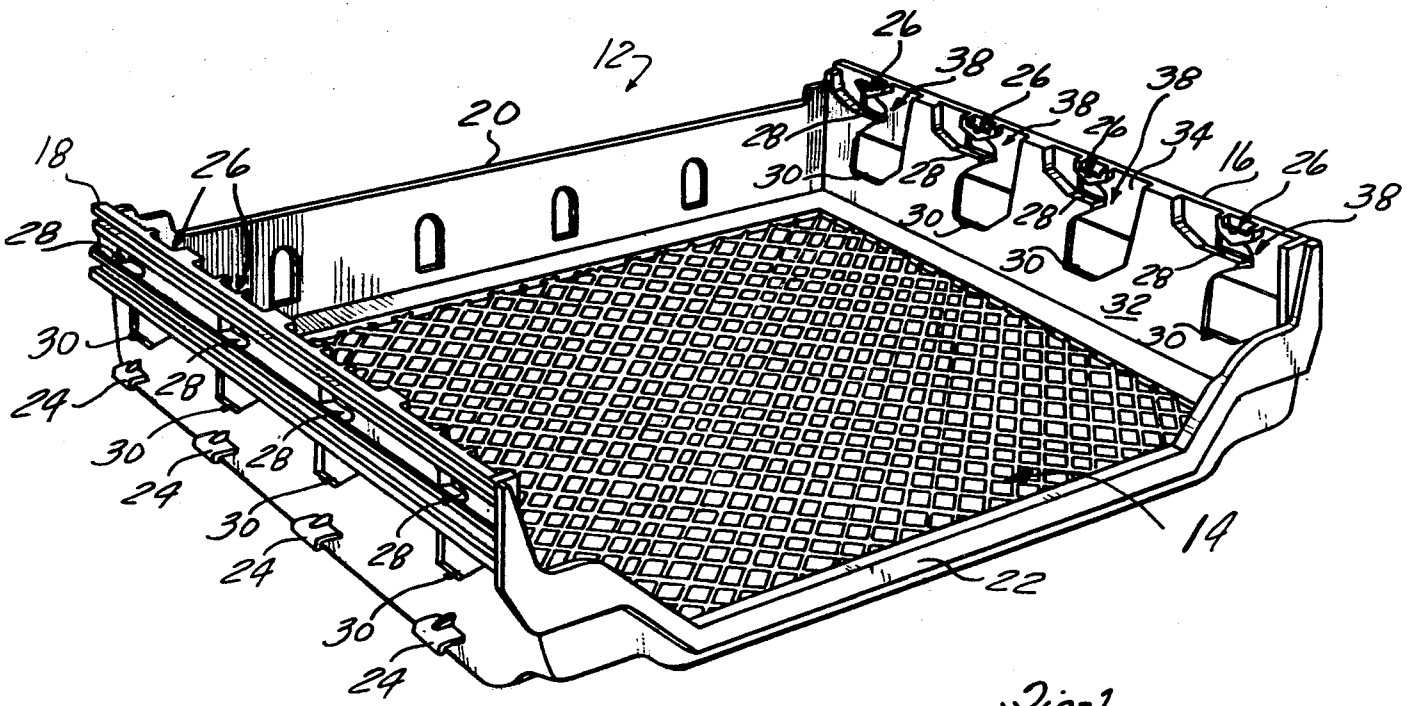
FIG. 1 is a perspective view of a container embodying the present invention.

As best seen in FIG. 1, a container designated generally 12 embodying the present invention includes a generally rectangular bottom 14 having a pair of opposed end walls 16 and 18 projecting upwardly from opposite ends of bottom 14, a rear wall 20 and a relatively low front wall 22. Typically, the container 12 is formed of a molded plastic material, such a polyethylene or polypropylene.

End walls 16 and 18 are of similar structure and differ from each other only in that one is a mirror image of the other. End walls 16 and 18 are inclined outwardly in their upward extent from bottom 14, as best seen in the cross-sectional views of FIGS. 7 and 9, and rear wall 20 is similarly inclined so that like containers may be nested within one another to form a stable stack in a manner to be described below.

Figure 3:
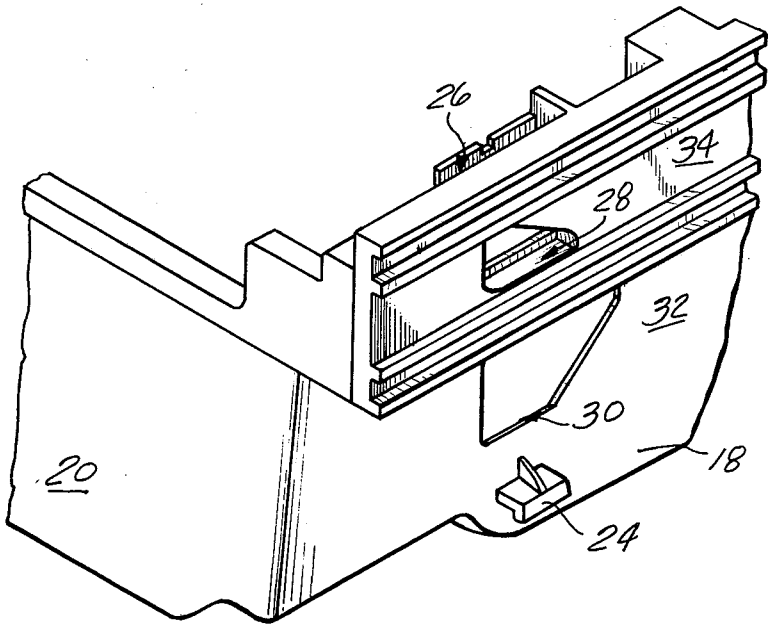
FIG. 3 is a perspective view of the portion of the container shown in FIG. 2 taken from a different angle.
Figure 2:
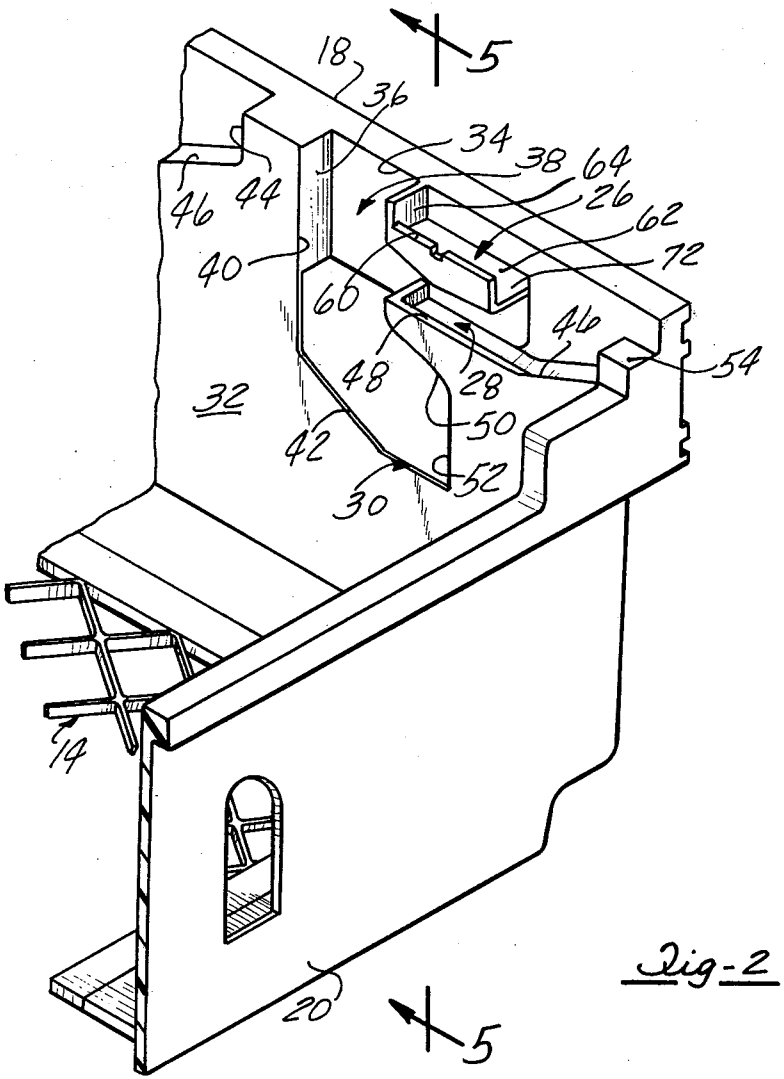
FIG. 2 is a perspective view showing details of one corner of the container of FIG. 1.

As best seen in FIG. 1, a series of horizontally spaced and aligned support feet 24 project outwardly from the outer side of end wall 18 near the lower edge of the end wall. A similar set of support feet 24 are likewise fixedly mounted on the outer side of end wall 16. Referring now particularly to FIGS. 1, 2 and 3, it is seen that a set of three support seats 26, 28 and 30 are provided on each of end walls 16 and 18 above each of the individual support feet 24. Referring particularly to FIG. 2, it is seen that end wall 18 (and also end wall 16) is formed with a main inner web 32 which extends upwardly from bottom 14 to the top edge of the end wall and an upper outer web 34 which extends downwardly from the top edge of the end wall in an outwardly spaced, parallel relationship to the general plane of the main web 32. Upper web 34 is fixedly mounted upon main web 32 by a plurality of spacers such as 36 which may be integrally formed on outer web 34 and adhesively or thermally bonded to inner web 32, for example.

Each vertically aligned set of support seats 26, 28 and 30 is located within a recess designated generally 38 formed in the inner side of end wall 18 (and 16). The recess is defined in part by an opening extending downwardly from the top edge of main web 32, the opening being defined by a first vertical edge 40 which merges at its lower end with a downwardly inclined edge section 42 which leads to a lower horizontal edge of the opening which constitutes the lower seat 30. At the opposite side of the opening which defines recess 38, a second vertical edge 44 extends downwardly from the top edge of main web 32 (at left-hand side of spacer 36 in FIG. 2) and merges at its lower end in a downwardly inclined edge section 46 which in turn merges at its lower end with a second horizontal edge section 48 which constitutes a portion of the intermediate level seat 28. The opening is completed by edge sections 50 and 52.

The opening in main web 32 which defines the recess 38 located adjacent rear wall 20, as shown in FIG. 2, defines the rearward vertical edge of the opening corresponding to edge 44 being defined by the front surface of a guide element 54 on rear wall 20, whose function will be described below.

Figure 5:
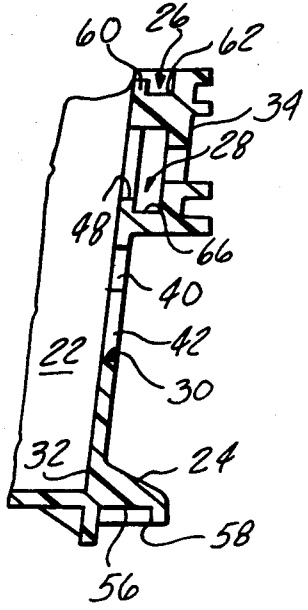
FIG. 5 is a cross-sectional view taken approximately on the line 5—5 of FIG. 2.
Figure 4:
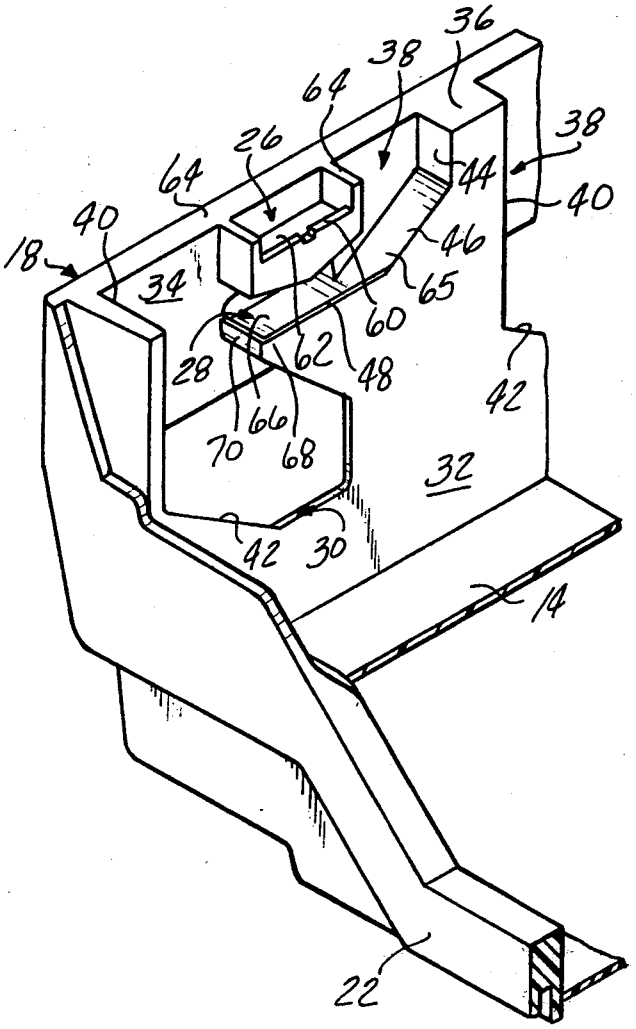
FIG. 4 is a perspective view of another corner of the container of FIG. 1.

The relationship between the support feet 24 and the support seats 26, 28 and 30 is best seen in FIGS. 4 and 5. As best seen in the cross-sectional view of FIG. 5, each support foot 24 is formed with a horizontal, downwardly facing support surface 56 and a downwardly projecting flange or toe 58 is located along the outer edge of the support surface 56. The horizontal outward extent of the surface 56 from the outer side of main web 30 is such that the line of juncture of surface 56 and main web 32 is located slightly inwardly—that is, to the left as viewed in FIG. 5—of the line of juncture of the horizontal edge defining the lower seat 30 with the inner surface of main web 32. The outer edge of surface 56 where it joins flange 58 is offset outwardly, to the right as viewed in FIG. 5, of the right-hand edge of an upwardly projecting lip 60 which forms part of the upper support seat 26.

Upper support seat 26 includes a horizontal platform 62 which is fixedly secured to and projects inwardly from upper web 34. At the inner edge of platform 62, lip 60 projects slightly upwardly above the surface of platform 62, for a purpose to be described below, and, as best seen in FIG. 4, upwardly projecting side walls 64 are located at each end of platform 62, platform 62 thus defining a bottom to a pocket which constitutes the seat 26. Lip 60 lies in the same general plane as main web 32.

As best seen in FIG. 4, intermediate support seat 28 includes a first web 65 which extends between main web 32 and upper web 34 along inclined edge section 46. A second horizontal web 66 extends between main web 32 and upper web 34 slightly below horizontal edge 48 to define an upwardly projecting lip 68 along this portion of intermediate support seat 28. A relatively low lip 70 is located at the free end of the platform section 66 of intermediate seat 28.

Returning now to FIGS. 2 and 3, the upper support seat 26 on each end wall which is adjacent the rear wall 20 of the container is modified from the upper support seat construction described above in that the wall section 64 at the rearward end of the seat is omitted and a downwardly inclined ramp section 72 is formed at the rearward end of the platform 62. The purpose of this arrangement is to facilitate a sliding movement of one container across the top of another into an upper stacked position in a manner to be described below.

Figure 6:
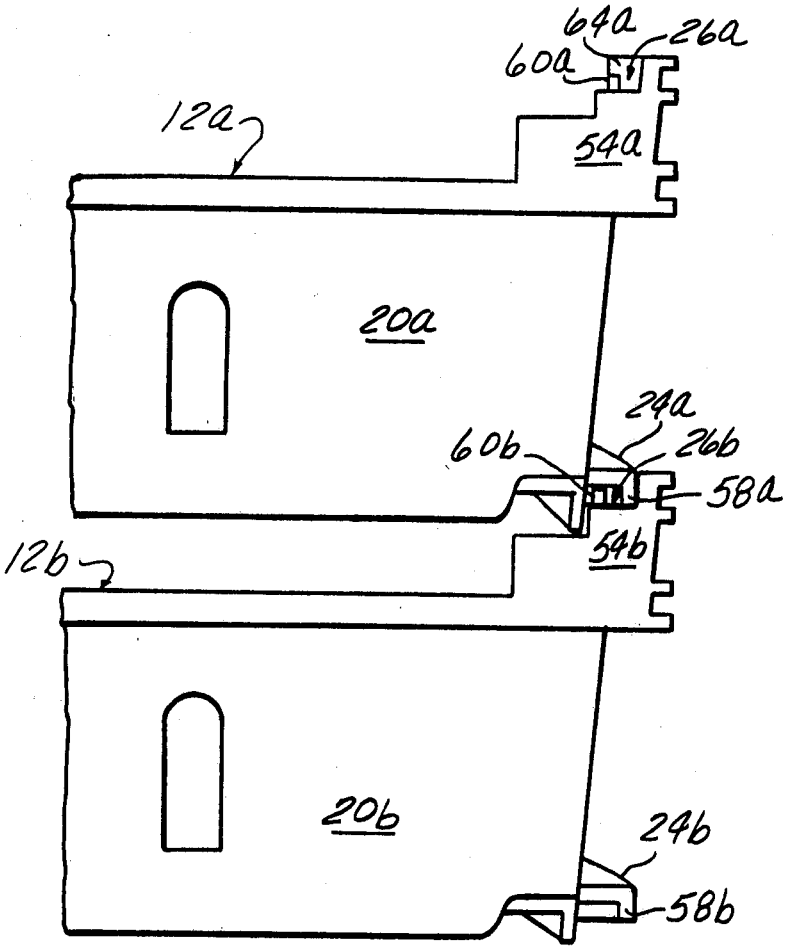
FIG. 6 is a side elevational view of a portion of two containers stacked at a high-level relationship relative to each other.

In FIG. 6, there is shown a rear view of portions of two like containers in which container **12*a* is stacked at an upper level with respect to the lower container 12*b*. Various parts of the two containers are identified by reference numerals carrying the suffix "a" or "b" identifying parts respectively on container 12*a* and container 12*b*. Container 12*a* is supported at the upper elevation relative to container 12*b* by engaging the support feet 24*a* of the upper container in the upper support seats 26*b* of the lower container. It will be noted that the downwardly projecting flange 58*a* of the upper container is hooked behind or outwardly of the lip 60*b* of the upper seat 26*b* of the lower container, a similar arrangement taking place at the opposite side, not shown, of the two stacked containers so that outward movement of the upper portion of the lower container end wall is restricted by the engagement between the flanges 58*a* on the upper container and the lips 60*b*** on the lower container. Outward flexing of the container end walls in this manner can occur, particularly when a large number of loaded containers are stacked one upon the other.

While the two containers **12*a* and 12*b* obviously may be manually stacked one upon the other by simply lowering the upper container 12*a* to place the support feet 24*a* of the upper container in the upper support seats 26*b* of the lower container, such a lowering operation requires the worker to precisely align the eight feet 24 on the upper container with the eight upper seats 26 on the lower container. This is often easier said than done because the seats on the lower container become blocked from view as the upper container is lowered. The support guide elements 54 and ramps 70 associated with the rearwardmost upper support seats 26** described above overcome this alignment problem.

The containers are conventionally stacked with their front side (wall 22) facing the person doing the stacking. To utilize surfaces 54 and 72 in the stacking operation, the container to be placed upon the stack is held in a position in which the container is inclined downwardly toward its rearward side. With the container inclined in this manner, it is lowered until the rearward support feet 24 of the container held rests upon the two support surfaces 54 at the rearward side of the top container in the stack. This action accurately locates the container being held from side to side relative to the stack because the outer sides of the rearwardmost support feet 24 of the container being held must be located between the opposed upper web portions 34 of the underlying container end walls before the support feet can contact the support surfaces 54 of the underlying container. The worker can tell when the feet 24 of the container he is holding rests on the support surfaces 54 of the underlying container by feel.

He then simply rapidly pulls the container he is holding forwardly, and the rear support feet 24 of that container will engage the ramps 72 (FIG. 2) as the upper container is pulled forwardly and further forward movement of the upper container will advance the rear support seat of the held container forwardly across the rear platform 62 until the support feet hit the front walls 64 of the rearward upper seats 26 of the lower container. At this time, the worker simply lowers the front end of the container he is holding and the remainder of its support feet drop into the upper support seats of the lower container.

Figure 7:
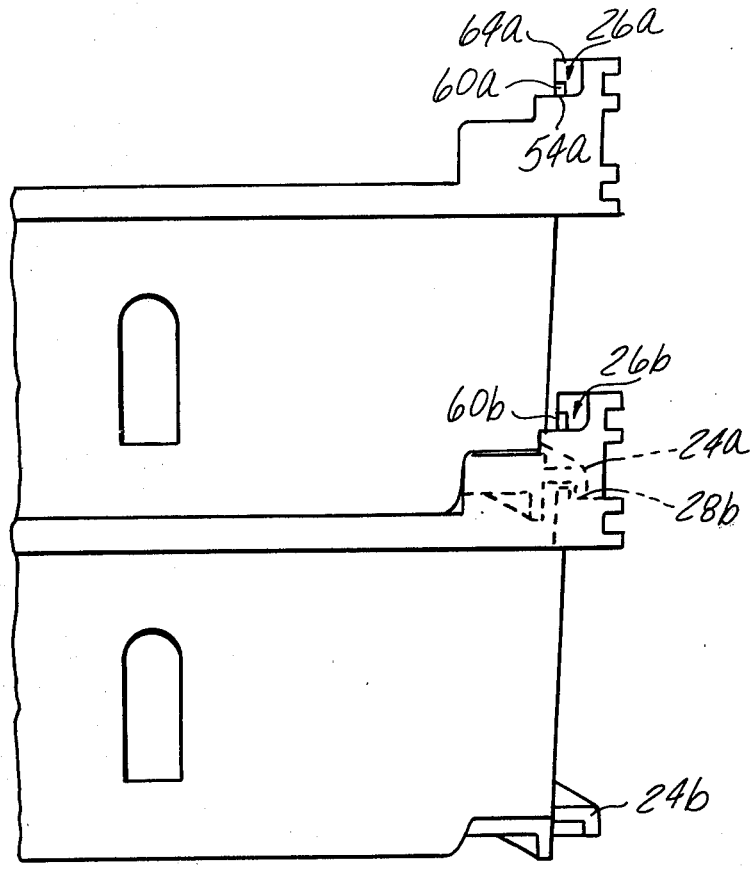
FIG. 7 is a view similar to FIG. 6, showing the two containers stacked at an intermediate level relative to each other.
Figure 8:
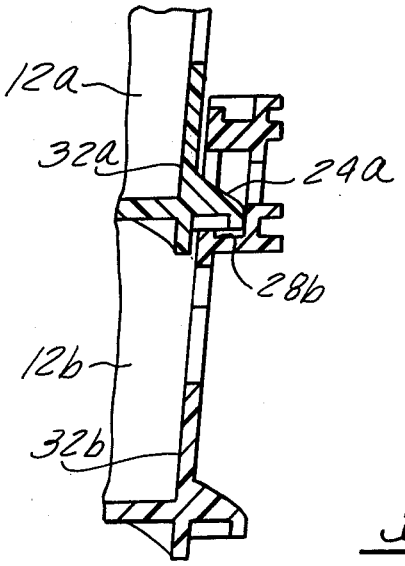
FIG. 8 is a detailed broken, cross-sectional view showing the relationship between the stacking feet and stacking seat of two containers when stacked in the intermediate level relationship with each other.

In FIGS. 7 and 8, the two containers 12*a* and 12*b* are shown stacked at the intermediate level position in which the support feet 24*a* of the upper container are supported upon the intermediate support seats 28*b* of the lower container.

To stack containers in the intermediate level relationship of FIGS. 7 and 8, the worker again manually locates the upper container above the lower container in a position such that the support feet of the upper container are located just rearwardly of the upper support seats 26 of the lower container. The upper container is then lowered until its support feet, which may be observed by the worker insofar as the front feet are concerned, pass downwardly between the rear of the upper support seat and vertical edge 44 of recess 38. As soon as the support feet are located in this position, the upper container may be simply dropped or lowered, the support feet of the upper container engaging the downwardly inclined ramp section 46 (FIG. 4) and sliding downwardly along this ramp to pass beneath upper support seat 26 onto the intermediate support platform 66 until the support feet engage the lip 70 at the end of platform 66.

Figure 9:
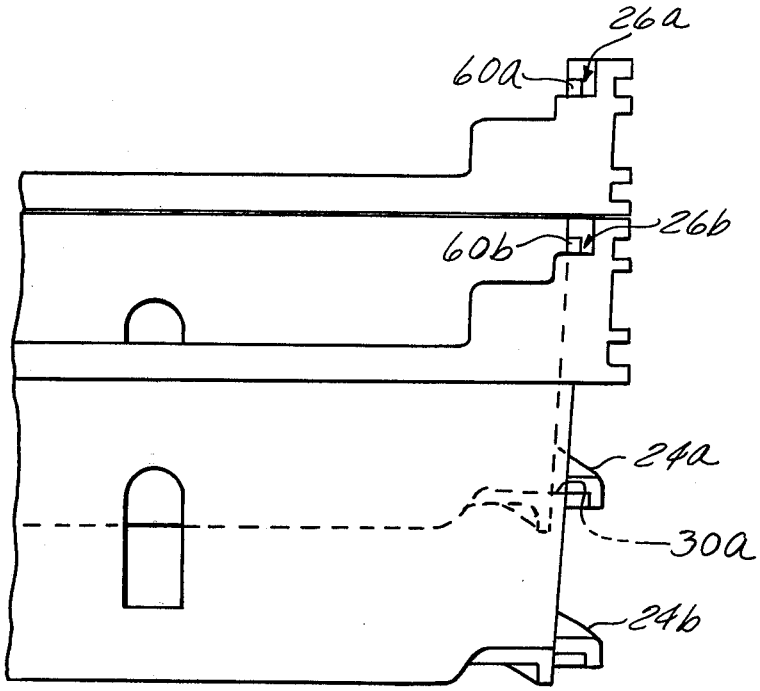
FIG. 9 is a side elevational view of portions of two containers stacked in low-level relationship with each other.
Figure 10:
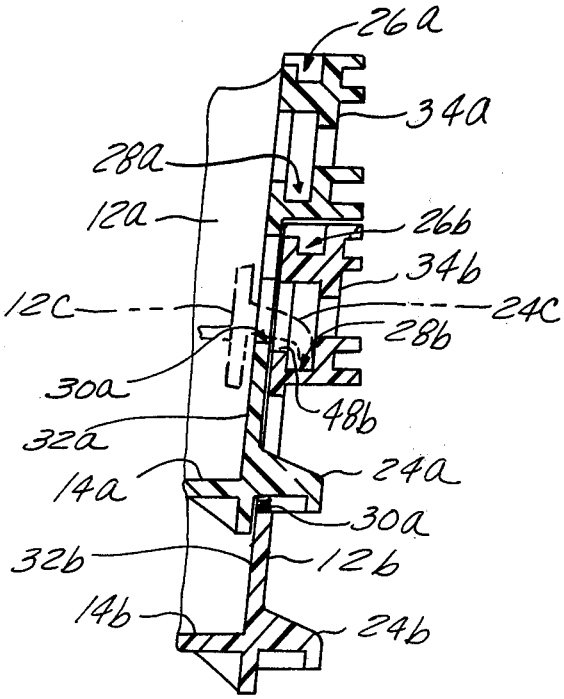
FIG. 10 is a detailed broken, cross-sectional view showing the relationship between the stacking feet and stacking seat of two containers stacked in a low-level relationahip with each other.

In FIGS. 9 and 10, the two containers 12*a* and 12*b* are shown in their low-level stacked relationship in which these support feet 24*a* of the upper container rest upon the horizontal edge 30 of main web 32. To stack the containers in this manner, the worker simply lowers the support feet 24 of the upper container downwardly through the space between the upper support seats 26 of the lower container and the first vertical edge 40 of the recess defining opening. In this instance, the support feet pass downwardly in front of the respective upper seats of the lower container. Again, the upper container is lowered until its support feet engage the inclined edges 42 of the opening in main web 32, this inclined edge subsequently guiding the support feet of the upper container downwardly onto the lower support seat defined by edge 30.

In FIG. 10, a third container is partially indicated at 12*c*, and it should be noted that the support feet 24*c* of this third container are supported upon the edge 30*a* of container 12*a* and also project inwardly beyond the edge 48*b* of the intermediate seat of the lower of the three containers.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. In an open-topped, stackable container having a rectangular bottom and a pair of opposed end walls projecting upwardly at a slight outward inclination from opposite ends of said bottom whereby one of said containers may receive a like container in a nested or stacked relationship therein; the improvement comprising a plurality of outwardly projecting, horizontally spaced and aligned support feet fixedly mounted on the outer side of each end wall adjacent the lower edge of said end wall, means defining a plurality of support foot receiving recesses in the inner side of each of said end walls respectively above each of said support feet, each of said recesses extending downwardly from the top of the end wall, means defining vertically spaced and vertically aligned upper, intermediate and lower support seats in each of said recesses, each of said support seats being adapted to receive and support a support foot of a like container to support the like container respectively at an upper, an intermediate or a lower level upon the end wall, said upper seat being located adjacent the top of said end wall and centrally of the width of the recess, first guide means on said end wall at one side of said upper seat for guiding a support foot of a like container downwardly in said recess to said intermediate seat, and second guide means on said end wall at the opposite side of said upper seat for guiding a support foot of a like container downwardly in said recess to said lower seat.

2. The invention defined in claim 1 wherein each end wall comprises a main inner web extending upwardly from said bottom to the top of said end wall, said main web having openings therethrough extending downwardly from the top edge of said main web partially defining said recesses, an upper outer web extending downwardly from the top edge of said end wall in outwardly spaced, generally parallel relationship to said main web, said upper seats being fixedly mounted on said outer web and projecting inwardly therefrom, said intermediate seats being mounted upon and extending between said main and outer webs, and said lower seats being defined by the lower edges of said openings in said main web.

3. The invention defined in claim 2 wherein said main web lies in an upwardly and outwardly inclined general plane and said upper seats project inwardly from said outer web to inner sides lying in said general plane.

4. The invention defined in claim 3 wherein each of said support feet comprises a support web having a downwardly facing horizontal surface projecting outwardly from said end wall from an inner edge offset inwardly from vertical alignment with the inner surface of said main web at the lower edge of the associated opening in said main web, said horizontal surface having an outer edge offset outwardly from vertical alignment with the inner side of the associated upper seat.

5. The invention defined in claim 4 wherein each of said support feet further comprises a flange projecting downwardly from said support web below said horizontal surface at said outer edge thereof, and each of said upper support seats comprises an upwardly projecting retaining lip extending along its inner side adapted to be disposed inwardly of a flange on a support foot of a like container when the last-mentioned support foot is seated upon the upper support seat.

6. The invention defined in claim 1 wherein each end wall comprises a main inner web extending upwardly from said bottom to the top of said each wall, said means defining said recesses including means defining an opening through said main web for each of said recesses, each opening being bounded by opposed vertical edge sections extending downwardly from the top of said end wall at opposite sides of the upper seat and respectively spaced from the adjacent side of the upper seat by a distance exceeding the width of a support foot, each of said vertical edge sections respectively merging at its lower end with an inwardly and downwardly inclined edge section respectively constituting said first and second guide means, each of said inclined edge sections respectively merging at its lower end with a horizontal edge section respectively constituting a portion of said intermediate and lower seats.

7. The invention defined in claim 6 wherein said end wall further comprises an upper outer web extending downwardly from the top edge of said end wall in outwardly spaced, parallel relationship to said main web, wall sections extending between said main and outer webs along said vertical edge sections of said openings in said main web fixedly mounting said outer web upon said main web, and means mounting said upper seats on the inner side of said outer web.

8. The invention defined in claim 6 wherein the horizontal edge section defining a portion of said lower seat terminates at its end remote from the associated inclined section at an upwardly extending side edge establishing an end limit to sidewise movement of a support foot seated on said lower seat.

9. The invention defined in claim 7 further comprising a horizontal support web extending between and commonly secured to said main and outer webs in downwardly spaced, coextensive relationship to the horizontal edge section defining said intermediate seat, and a retaining lip projecting upwardly from said horizontal web at the end thereof remote from the associated inclined edge section to establish an end limit to sidewise movement of a support foot seated on said intermediate seat.

10. In an open-topped, stackable container having a retangular bottom and a pair of opposed end walls projecting upwardly at a slight outward inclination from opposite ends of said bottom whereby one of said containers may receive a like container in a nested, stacked relationship therein; the improvement comprising a plurality of outwardly projecting horizontally spaced and aligned support feet fixedly mounted on the outer side of each end wall adjacent the lower edge thereof, a plurality of horizontally spaced upper support seats fixedly mounted on the inner side of each end wall adjacent the upper edge thereof in respective vertical alignment with said support feet, each support foot including a horizontal web and a vertical flange projecting downwardly from said web along the outer edge thereof, each of said upper seats including a horizontal platform having a first upwardly projecting lip extending along the inner edge thereof and a second upwardly projecting lip extending along at least one side edge thereof, said first lips of said upper seats being vertically offset inwardly of the flanges of the vertically aligned support feet whereby, when the support feet of a first container are seated on the upper seats of a second like container, the flanges of the feet of the first container are located outwardly of the first lips of the upper seats of the second container to limit outward flexing of the end walls of said second container.

11. The invention defined in claim 10 further comprising means defining a first and a second support foot receiving recess on the inner side of each of said end walls extending downwardly from the top edge of the end wall respectively at opposite sides of each upper seat, means defining an intermediate support foot receiving seat at the lower end of each first recess vertically spaced below and aligned with the associated upper seat, and means defining a lower support foot receiving seat at the lower end of each second recess vertically spaced below and aligned with the associated intermediate seat.

12. The invention defined in claim 10 further comprising a guide surface located at one end of each of said end walls in spaced horizontal alignment with the platform of the adjacent upper seat, the last-mentioned platform having a second lip only at that side edge of said last-mentioned platform remote from said guide surface, and a downwardly inclined ramp on said last-mentioned platform at the side edge thereof adjacent said guide surface, the remaining upper seats having a second lip at both side edges of their respective plaforms.

* * * * *